US008485070B2

(12) United States Patent
Darbinyan

(10) Patent No.: US 8,485,070 B2
(45) Date of Patent: Jul. 16, 2013

(54) T-HANDLE WRENCH

(75) Inventor: Hrayr Darbinyan, Yerevan (AM)

(73) Assignee: JPJ Investment Holding Corp., City of Industry, CA (US)

( * ) Notice: Subject to any disclaimer, the term of this patent is extended or adjusted under 35 U.S.C. 154(b) by 227 days.

(21) Appl. No.: 12/916,250

(22) Filed: Oct. 29, 2010

(65) Prior Publication Data

US 2011/0100166 A1 May 5, 2011

Related U.S. Application Data

(60) Provisional application No. 61/256,137, filed on Oct. 29, 2009.

(51) Int. Cl.
*B25B 13/28* (2006.01)
*B25B 23/16* (2006.01)

(52) U.S. Cl.
USPC ..... 81/90.1; 81/112

(58) Field of Classification Search
USPC ..... 81/90.1–90.3, 92–99, 100–118, 150–154, 81/29, 53.12, 53.2
See application file for complete search history.

(56) References Cited

U.S. PATENT DOCUMENTS 499,919 A * 6/1893 Griffin et al. ..... 81/116
524,412 A * 8/1894 Bernheim ..... 81/63
524,770 A * 8/1894 Smith ..... 81/113
558,451 A * 4/1896 Ellis ..... 81/113
664,226 A * 12/1900 Meyer ..... 168/45
690,647 A * 1/1902 Garrett ..... 81/62
803,669 A * 11/1905 Cook ..... 192/44
803,692 A * 11/1905 Hill ..... 81/113
837,225 A * 11/1906 Holman ..... 81/112
935,047 A * 9/1909 McLaughlin ..... 81/29
961,203 A * 6/1910 Batchelor ..... 279/39
968,858 A * 8/1910 Kornberg ..... 81/62
978,208 A * 12/1910 Reilly ..... 81/113
1,051,021 A * 1/1913 Skinner ..... 74/126
1,132,550 A * 3/1915 Bodmer ..... 279/56
1,243,860 A * 10/1917 Olson et al. ..... 81/112
1,387,921 A * 8/1921 Gunnar ..... 81/29
1,509,067 A * 9/1924 Drummond ..... 81/61
1,786,701 A * 12/1930 Butlin ..... 81/57
2,216,557 A * 10/1940 McKean ..... 81/112
2,240,556 A * 5/1941 Eide ..... 81/111
2,257,089 A * 9/1941 Caminez ..... 81/128
2,334,088 A * 11/1943 Haas et al. ..... 81/113
2,390,034 A * 11/1945 Walker ..... 81/53.2
2,434,354 A * 1/1948 Emmons ..... 81/53.2
2,435,137 A * 1/1948 Geertsema ..... 81/113
2,634,641 A * 4/1953 Hodges ..... 81/113
2,648,564 A * 8/1953 Tarapacki ..... 294/115
2,654,632 A * 10/1953 Herbert ..... 294/116
2,669,896 A * 2/1954 Clough ..... 81/128
2,701,489 A * 2/1955 Osborn ..... 81/53.2
3,339,439 A * 9/1967 Van Dalen et al. ..... 81/112

(Continued)

*Primary Examiner* — David B Thomas
(74) *Attorney, Agent, or Firm* — Patterson & Sheridan, L.L.P.

(57) ABSTRACT

The present invention generally relates to a T-Handle wrench. In one aspect, a wrench is provided that includes a shaped handle. The wrench further includes a plurality of jaws operatively attached to the handle. The wrench also includes a sleeve member disposed around the jaws. Additionally, the wrench includes a push button assembly configured to move the sleeve member relative to the jaws, wherein the movement of the sleeve member causes the jaws to move between a retracted position and an extended position. In another aspect, a method of operating a wrench is provided.

28 Claims, 5 Drawing Sheets

U.S. PATENT DOCUMENTS 3,358,533 A * 12/1967 Wren ..... 81/128
3,373,639 A * 3/1968 Van Dalen et al. ..... 81/112
3,377,893 A * 4/1968 Shorb ..... 81/113
3,898,897 A * 8/1975 Jauhiainen ..... 81/114
4,763,548 A * 8/1988 Leibinger et al. ..... 81/453
5,067,376 A * 11/1991 Fosella ..... 81/115
5,207,130 A * 5/1993 Payne ..... 81/90.2
5,213,015 A * 5/1993 Disston, Jr. ..... 81/90.9
5,218,890 A * 6/1993 Christ, Jr. ..... 81/113
5,740,704 A * 4/1998 Payne ..... 81/60
5,988,023 A * 11/1999 Townsend et al. ..... 81/90.2
6,000,300 A * 12/1999 Plamondon ..... 81/90.2
6,134,992 A * 10/2000 Perkins ..... 81/90.5
6,539,826 B2 * 4/2003 Oesterle et al. ..... 81/90.2
6,945,145 B1 * 9/2005 Kesinger ..... 81/487
7,878,092 B1 * 2/2011 Eby et al. ..... 81/112
7,938,044 B2 * 5/2011 Ensign ..... 81/90.2
2001/0016750 A1 * 8/2001 Malecki et al. ..... 606/158
2006/0162504 A1 * 7/2006 George ..... 81/90.2
2010/0018358 A1 * 1/2010 Power ..... 81/90.2

* cited by examiner

T-HANDLE WRENCH

CROSS-REFERENCE TO RELATED APPLICATIONS

This application claims benefit of U.S. provisional patent application Ser. No. 61/256,137, filed Oct. 29, 2009, which is herein incorporated by reference.

BACKGROUND OF THE INVENTION

1. Field of the Invention

Embodiments of the present invention generally relate to a ratchet wrench. More particularly, the present invention relates to a T-Handle wrench.

2. Description of the Related Art

A conventional ratchet wrench includes a wrench head attached to a handle. The wrench head includes a shaft configured to receive a socket. The socket is used to engage an object, such as a bolt head. Generally, the socket is used for a single sized bolt head. The conventional ratchet wrench also includes a grip and slide mechanism configured to allow the wrench head and the socket to rotate relative to the handle in a first direction and remain fixed relative to the handle in a second direction. Even though the conventional ratchet wrench may be useful in rotating the bolt head, there is still a need for an improved ratchet wrench.

SUMMARY OF THE INVENTION

The present invention generally relates to a T-Handle wrench. In one aspect, a wrench is provided that includes a shaped handle. The wrench further includes a plurality of jaws operatively attached to the handle. The wrench also includes a sleeve member disposed around the jaws. Additionally, the wrench includes a push button assembly configured to move the sleeve member relative to the jaws, wherein the movement of the sleeve member causes the jaws to move between a retracted position and an extended position.

In another aspect, a method of operating a wrench is provided. The method includes the step of providing a wrench having a shaped handle with jaws operatively attached via pin members and a sleeve member disposed around the jaws. The method also includes the step of moving the sleeve member from an upper portion of the jaws to a lower portion of the jaws. Additionally, the method includes the step of rotating the jaws around the pin members from a retracted position to an extended position.

In a further aspect, a wrench is provided. The wrench includes a T-shaped body. The wrench further includes a plurality of jaws, wherein each jaw has an upper portion attached to the T-shaped body via a pin and a lower portion that includes a tapered surface. Additionally, the wrench includes a sleeve member disposed around the jaws, wherein the sleeve member has an inner surface that interacts with the tapered surface of the lower portion of each jaw when the sleeve member moves relative to the jaws.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
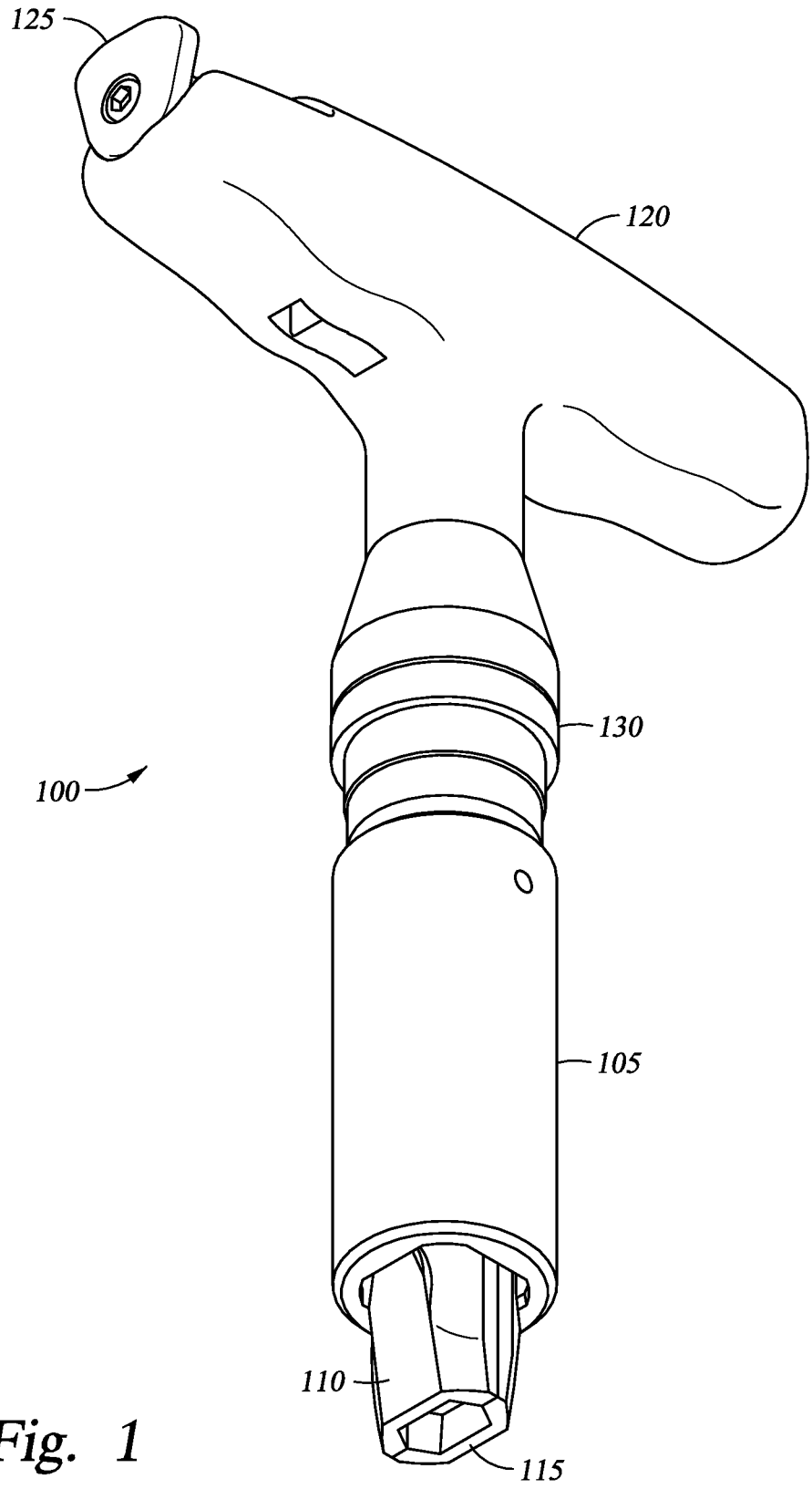
FIG. 1 is a perspective view of a T-Handle wrench.

FIG. 1 is a perspective view of a T-Handle wrench 100. Generally, the T-Handle wrench 100 is configured to grip an object and then allow a user to apply a torque to the object. As shown, the T-Handle wrench 100 includes a handle 120, a push button 125, a collar member 130, a sleeve member 105 and jaws 110, 115. As will be described herein, a user will apply a force to the push button 125 which causes the sleeve member 105 to move away from the handle 120. As a result, a lower portion of the jaws 110, 115 will move radially outward to allow the T-Handle wrench 100 to grip the object, such as a bolt head.

Figure 3:
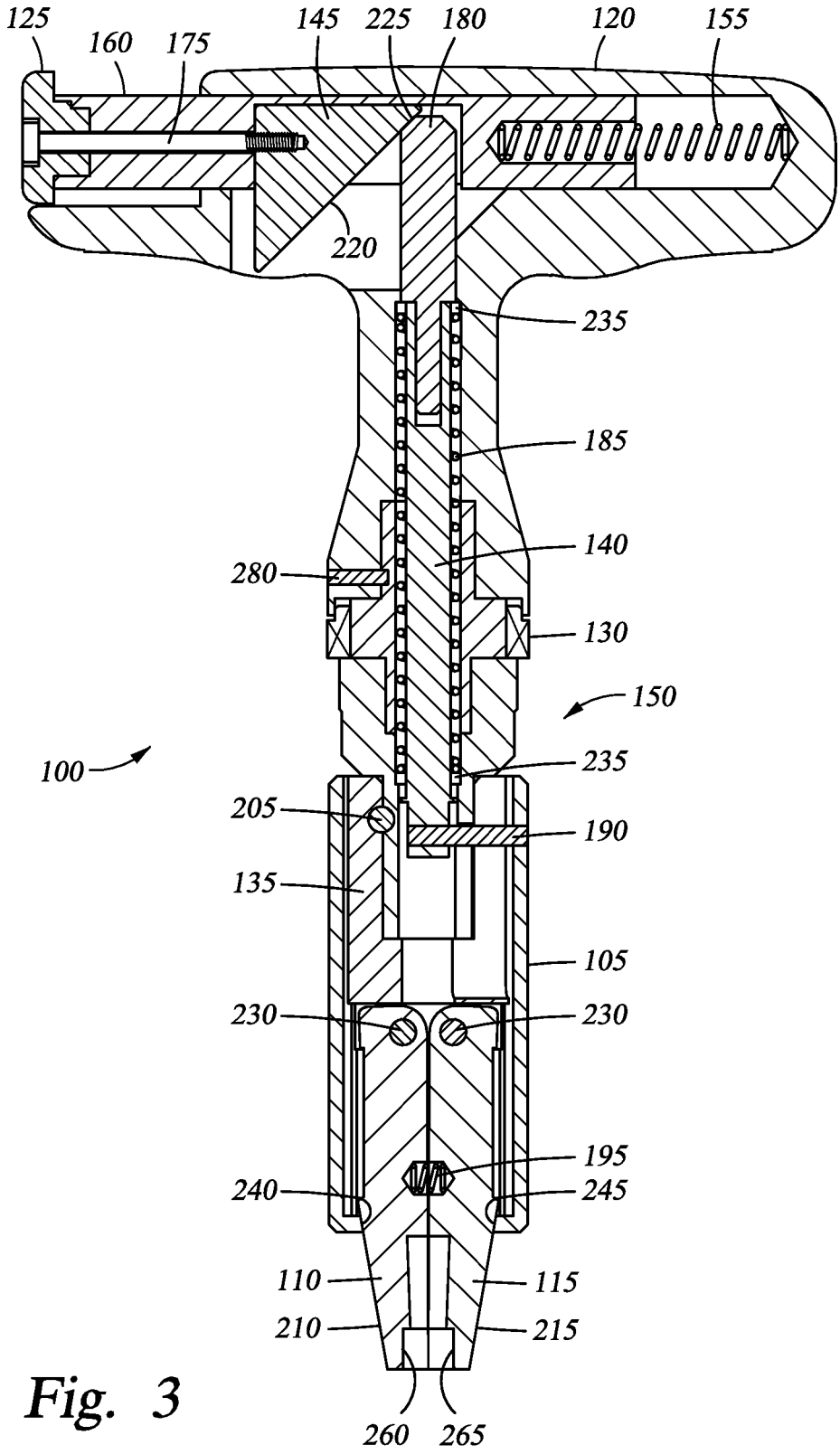
FIG. 3 is a sectional view of the T-Handle wrench with jaws in a retracted position.
Figure 4:
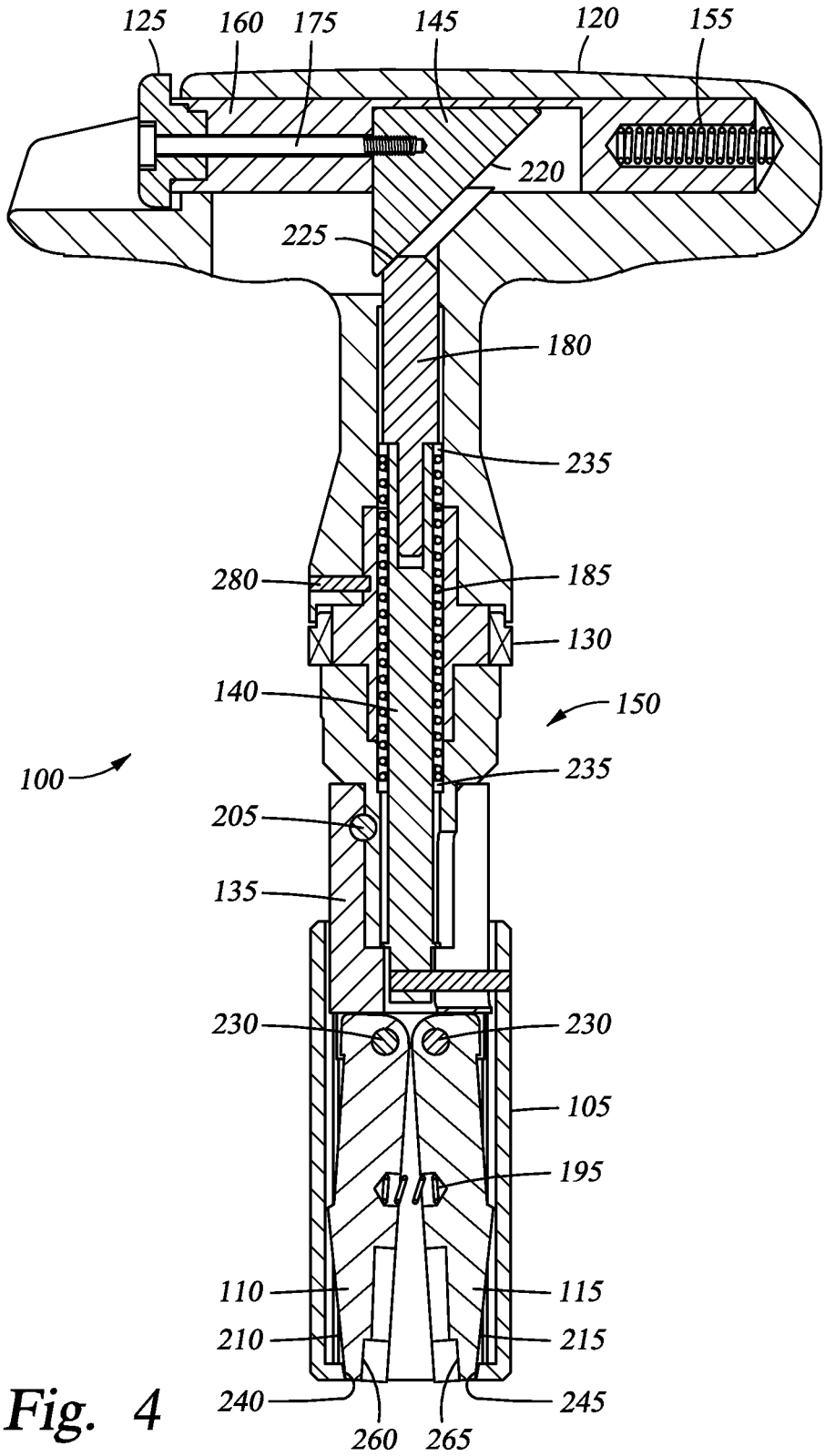
FIG. 4 is a sectional view of the T-Handle wrench with jaws in an extended position.

The jaws 110, 115 are movable between a retracted position (see FIG. 3) and an extended position (see FIG. 4). In the extended position, the jaws 110, 115 may be used to engage and grip the object. The jaws 110, 115 are also movable to any number of intermediate positions between the retracted position and the extended position. The intermediate positions allow the T-Handle wrench 100 to be used with a range of different sized objects (e.g. different sizes of bolt heads). The T-Handle wrench 100 in FIG. 1 shows two jaws, however, any number of jaws may be used without departing from the principles of the present invention.

Figure 2:
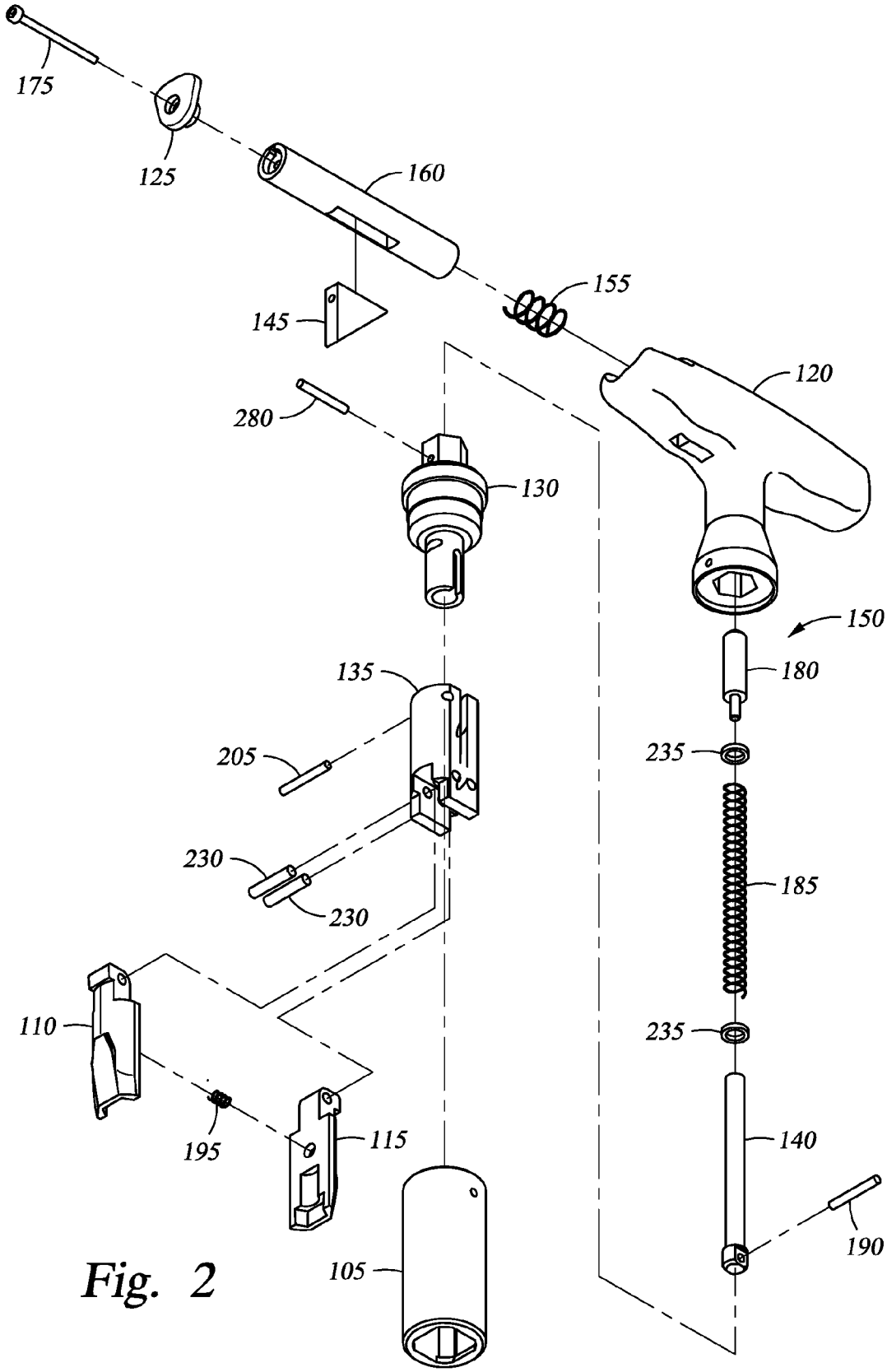
FIG. 2 is an exploded view of the T-Handle wrench.

FIG. 2 is an exploded view of the T-Handle wrench 100. As shown, the T-Handle wrench 100 includes a push button assembly 150. Generally, the push button assembly 150 is used to move the sleeve member 105 relative to the jaws 110, 115. The sleeve member 105 is connected to the push button assembly 150 via connection member 190. The push button assembly 150 includes the push button 125, a handle rod 160, a wedge member 145 and a button biasing member 155 which are disposed in the handle 120. The push button 125, the handle rod 160 and the wedge member 145 are interconnected via connection member 175. The push button assembly 150 further includes an upper push rod 180, a lower push rod 140, a rod biasing member 185 and washers 235. The rod biasing member 185 is configured to bias the upper push rod 180 into engagement with the wedge member 145. In the embodiment illustrated the components of the push button assembly 150 and the sleeve member 105 move relative to the other components of the T-Handle wrench 100. As will be described herein, the components of the push button assembly 150 interact with the other components of the T-Handle wrench 100 to allow the jaws 110, 115 to move The T-Handle wrench 100 further includes the collar member 130. Generally, the collar member 130 is a switch mechanism that allows the jaws 110, 115 to either rotate relative to the handle 120 or to be fixed relative to the handle 120. The collar member 130 is rotatable between a first position, a second position and a third position. In the first position, the jaws 110, 115 of the T-Handle wrench 100 are allowed to rotate relative to the handle 120 in a first direction and the jaws 110, 115 are fixed relative to the handle 120 in a second opposite direction. In the second position, the jaws 110, 115 of the T-Handle wrench 100 are fixed relative to the handle 120 in the first direction and the second opposite direction. In the third position, the jaws 110, 115 of the T-Handle wrench 100 are fixed relative to the handle 120 in the first direction and the jaws 110, 115 are allowed to rotate relative to the handle 120 in the second opposite direction. The collar member 130 is interconnected with a slide mechanism 135 via connection member 205 and the handle 120 via connection member 280.

FIG. 3 is a sectional view of the T-Handle wrench 100 with jaws 110, 115 in the retracted position. As shown, the jaws 110, 115 are held in the retracted position by the sleeve member 105. Specifically, the sleeve member 105 includes inner surfaces 240, 245 that are in contact with tapered surfaces 210, 215 of the jaws 110, 115 and the movement of the sleeve member 105 relative to the jaws 110, 115 controls rotational movement of the jaws 110, 115 around pins 230.

The interconnection of the components of the push button assembly 150 is also shown in FIG. 3. The push button 125, the handle rod 160, the wedge member 145 and the button biasing member 155 are disposed in the handle 120. The button biasing member 155 is configured to bias the wedge member 145 in a direction away from the upper push rod 180. The wedge block 145 includes a surface 220 that is configured to contact a surface 225 of the upper push rod 180. The movement of the push button 125 in a direction toward the upper push rod 180 compresses the button biasing member 155 and causes the surface 220 of the wedge block 145 to slide along the surface 225 of the upper push rod 180. As a result, the upper push rod 180 and the lower push rod 140 are urged away from the handle 120 and the rod biasing member 185 is compressed. The push rods 140, 180 are connected to the sleeve member 105 via connection member 190 and as such, the movement of the push rods 140, 180 causes the sleeve member 105 to move relative to the jaws 110, 115, thereby causing the tapered surfaces 210, 215 of jaws 110, 115 slide along the inner surfaces 240, 245 of the sleeve member 105. In turn, a biasing member 195 causes the jaws 110, 115 to rotate around the pins 230 to a desired position.

FIG. 4 is a sectional view of the T-Handle wrench with jaws in an extended position. As shown, the movement of the push button 125 in a direction toward the upper push rod 180 has compressed the button biasing member 155 and causes the surface 220 of the wedge block 145 to slide along the surface 225 of the upper push rod 180. As a result, the upper push rod 180 and the lower push rod 140 have been urged away from the handle 120 and the rod biasing member 185 is compressed. The movement of the push rods 140, 180 causes the sleeve member 105 to move away from the handle 120, thereby allowing the tapered surfaces 210, 215 of jaws 110, 115 slide along the inner surfaces 240, 245 of the sleeve member 105. At the same time, the jaws 110, 115 are biased outward by the biasing member 195 and rotate around the pins 230 to the desired position which may be the extended position or any number of intermediate positions.

Figure 5:
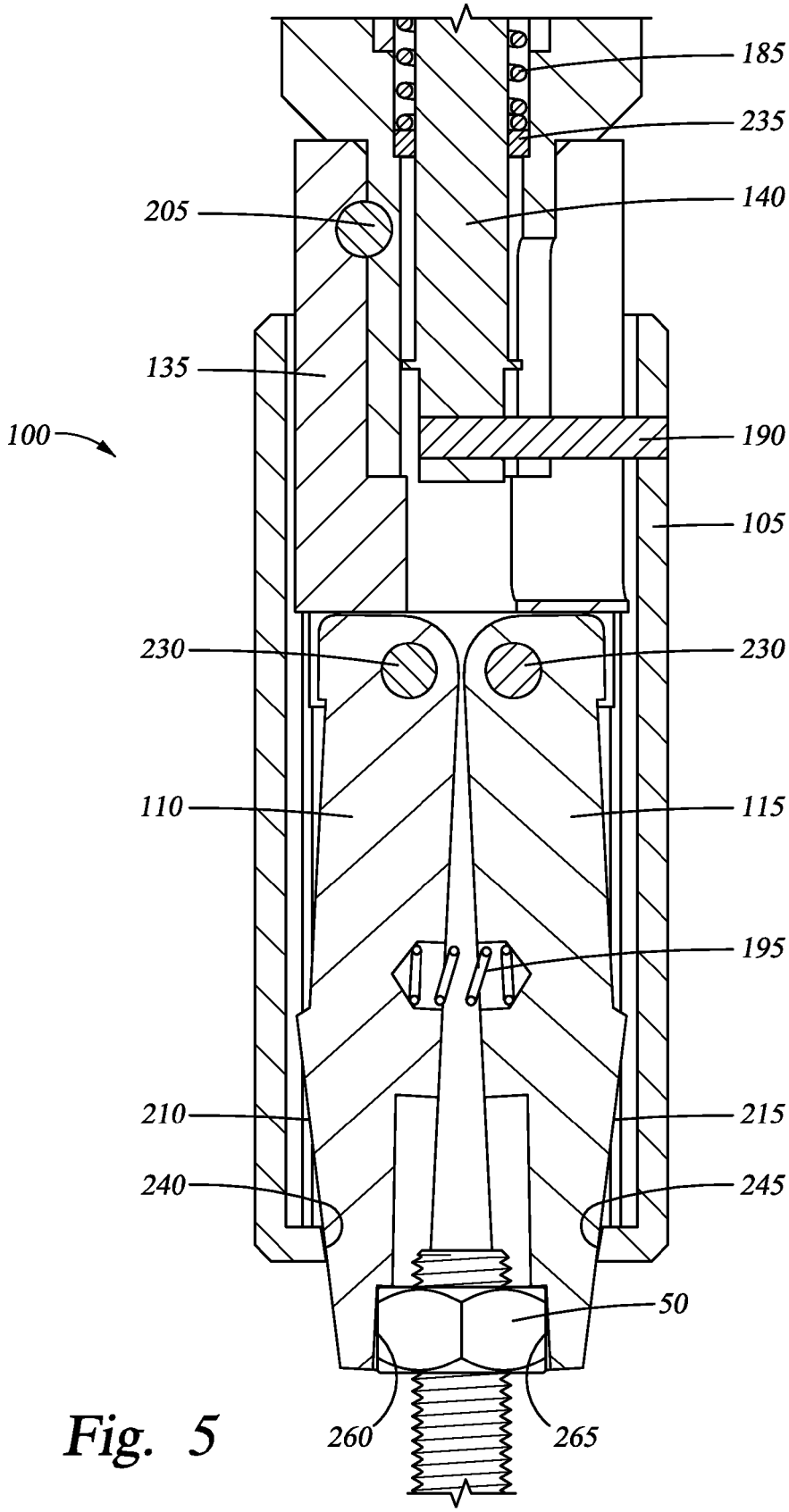
FIG. 5 is a view of the T-Handle wrench engaging an object.

FIG. 5 is a view of the T-Handle wrench 100 engaging an object 50. The movement of the push rods 140, 180 causes the sleeve member 105 to move relative to the jaws 110, 115, thereby allowing the tapered surfaces 210, 215 of jaws 110, 115 slide along the inner surfaces 240, 245 of the sleeve member 105. At the same time, the jaws 110, 115 rotate around the pins 230 to the desired position. In one embodiment, the desired position is when the inner diameter of the jaws 110, 115 proximate the gripping surface 260, 265 is larger than the outer diameter of the object 50. Thereafter, the gripping surfaces 260, 265 of the jaws 110, 115 may be placed around the object 50 and the push button 125 is released. Upon release of the push button 125, the biasing member 155 moves the wedge member 145 away from the upper push rod 180 which causes the surface 220 of the wedge block 145 to slide along the surface 225 of the upper push rod 180. As a result, the upper push rod 180 and the lower push rod 140 are urged toward the handle 120 and the rod biasing member 185 expands. The push rods 140, 180 are connected to the sleeve member 105 via connection member 190 and as such, the movement of the push rods 140, 180 causes the sleeve member 105 to move toward the handle 120. As the sleeve member 105 moves toward the handle 120, the tapered surfaces 210, 215 of jaws 110, 115 slide along the inner surfaces 240, 245 of the sleeve member 105. In turn, the jaws 110, 115 rotate around the pins 230 to move the inner gripping surfaces 260, 265 of the jaws 110, 115 into engagement with the object 50. Thereafter, the user may apply a torque to the object by using the T-Handle wrench 100. The T-Handle wrench 100 may be disengaged from the object 50 by moving the jaws 110, 115 to the extended position in a similar manner as described herein.

While the foregoing is directed to embodiments of the present invention, other and further embodiments of the invention may be devised without departing from the basic scope thereof, and the scope thereof is determined by the claims that follow.

The invention claimed is:

1. A wrench comprising:

a handle;

at least two jaws operatively attached to the handle and movable between retracted and extended positions, wherein the jaws are biased toward the extended position by a biasing member; and a sleeve member axially movable relative to the jaws, wherein movement of the sleeve member causes the jaws to move between the retracted and extended positions relative to an object to be engaged by the jaws and wherein the sleeve member is biased toward a position in which the jaws are in the retracted position.

2. The wrench of claim 1, further comprising a collar member disposed about the handle and configured to control a direction of rotation of the jaws relative to the handle.

3. The wrench of claim 1, further including an actuator operatively connected to the sleeve member to cause movement thereof, the actuator constructed and arranged to permit manipulation by the same hand of a user that operates the wrench.

4. The wrench of claim 3, wherein the actuator is a push button assembly including a push button, a wedge block and a push rod disposed in the handle, whereby a first portion of the push rod is in contact with the wedge block and a second portion of the push rod is connected to the sleeve member.

5. The wrench of claim 4, wherein the activation of the push button causes the wedge block to move the push rod away from the handle.

6. The wrench of claim 5, wherein the movement of the push rod causes the sleeve member to move relative to the jaws.

7. The wrench of claim 3, wherein:

the actuator moves a distance $L_1$ to cause movement of the sleeve, the sleeve moves a distance $L_2$ in response to movement of the actuator, and the ratio of the distances $L_1$:$L_2$ is approximately 1.

8. The wrench of claim 7, wherein the movement of the actuator is perpendicular to the movement of the sleeve.

9. The wrench of claim 1, wherein each jaw has an upper portion attached to the handle via a pin and a lower portion that includes a tapered surface.

10. The wrench of claim 9, wherein each jaw rotates around the respective pin to the extended position as the sleeve member moves from the upper portion of the jaw to the lower portion of the jaw.

11. The wrench of claim 9, wherein each jaw rotates around the respective pin to the retracted position as the sleeve member moves from the lower portion of the jaw to the upper portion of the jaw.

12. The wrench of claim 9, wherein the sleeve member includes an inner surface that interacts with the tapered surface of the lower portion of the jaw as the sleeve moves relative to the jaw.

13. The wrench of claim 1, wherein:

the at least two jaws move a distance $L_1$ apart when moved from the retracted position to the extended position, the sleeve member axially movable a distance $L_2$ to cause the jaws to move between the retracted and extended positions, and the ratio of the distances $L_2$:$L_1$ is approximately 10:3.

14. The wrench of claim 1, wherein;

the jaws are configured to engage an object having a first diameter when the jaws are in the retracted position, and the jaws are configured to engage an object having a second diameter when the jaws are in the extended position.

15. The wrench of claim 14, wherein the ratio of the second diameter to the first diameter is approximately 2.5.

16. The wrench of claim 14, wherein the jaws are configured to engage objects having a diameter between the first diameter and the second diameter when the jaws are between the retracted position and the extended position.

17. A method of operating a wrench, the method comprising:

providing a wrench having a shaped handle with jaws operatively attached via pin members and a sleeve member disposed around the jaws; and moving the sleeve member from a first position, in which the sleeve member holds the jaws in a retracted position, to a second position, in which the sleeve member allows the jaws to move to an extended position, wherein moving the sleeve member comprises overcoming a biasing force that biases the sleeve member towards the first position.

18. The method of claim 17, further comprising moving the sleeve member from the second position towards the first position, thereby causing the jaws to move from the extended position to an intermediate position which is the same as or wider than the retracted position.

19. The method of claim 17, further comprising positioning the jaws around an object when the jaws are in the extended position, the object having a diameter equal to the width of the jaws in the intermediate position.

20. The method of claim 19, further comprising gripping the object with the jaws by allowing the sleeve member to move from the second position towards the first position, thereby causing the jaws to move to the intermediate position.

21. The method of claim 20, further comprising applying a torque to the object by rotating the handle around an axis approximately in a center of the handle.

22. A wrench comprising:

a T-shaped body;

at least two jaws, wherein each jaw has an upper portion pivotally attached to the T-shaped body and a lower portion that includes an outer surface, the lower portion of the jaws being pivotally movable between a retracted position and an extended position; and a sleeve member disposed around the jaws, wherein:

the sleeve member has an inner surface that interacts with the outer surface of the lower portion of each jaw when the sleeve member moves relative to the jaws between a first position, in which the sleeve member holds the jaws in the retracted position, and a second position, in which a biasing member urges the jaws to the extended position; and the sleeve member is biased towards the first position.

23. The wrench of claim 22, wherein the T-shaped body comprises a handle configured to rotate about an axis of rotation approximately through the center of the handle and configured to apply a torque around the axis of rotation to an object held by the jaws.

24. The wrench of claim 22, further comprising a collar member disposed between the T-shaped body and the jaws, wherein the collar member is configured to control a direction of rotation of the jaws relative to the T-shaped body.

25. A self-adjusting wrench, comprising:

a handle;

at least two opposing jaws disposed on the wrench opposite the handle;

a first biasing member biasing the jaws towards an extended position;

a user-adjustable sleeve member movable between a first position, in which the sleeve member holds the jaws in a retracted position, and a second position, in which the jaws are allowed to move to the extended position; and a second, user-adjustable biasing member biasing the sleeve member towards the first position.

26. The self-adjusting wrench of claim 25, wherein the first biasing member is disposed between the jaws.

27. The self-adjusting wrench of claim 25, wherein the handle is configured to rotate about an axis of rotation approximately through the center of the handle and configured to apply a torque around the axis of rotation to an object held by the jaws.

28. The self-adjusting wrench of claim 25, wherein the second biasing member is axially movable relative to the jaws.

* * * * *